United States Patent [19]

Dahrendorf et al.

[11] Patent Number: 4,784,286

[45] Date of Patent: Nov. 15, 1988

[54] CLOSING DEVICE

[75] Inventors: Klaus-Dieter Dahrendorf; Volker Hunnebeck, both of Berlin, Fed. Rep. of Germany

[73] Assignee: Auergesellschaft GmbH, Berlin, Fed. Rep. of Germany

[21] Appl. No.: 122,009

[22] Filed: Nov. 18, 1987

[30] Foreign Application Priority Data

Nov. 18, 1986 [DE] Fed. Rep. of Germany ..... 3639421

[51] Int. Cl.[4] ..... B65D 45/16

[52] U.S. Cl. ..... 220/324; 220/315; 292/259 R

[58] Field of Search ..... 220/324, 315, 318, 326; 292/259 R, 307 R, 325

[56] References Cited

U.S. PATENT DOCUMENTS

| | | | |
|---|---|---|---|
| 1,232,385 | 7/1917 | Palmer | 220/315 X |
| 2,998,276 | 8/1961 | Shettler | 220/315 X |
| 3,140,795 | 7/1964 | Griffith et al. | 292/259 X |
| 3,746,205 | 7/1973 | Helguera | 220/324 X |
| 4,438,966 | 3/1984 | Eckstein et al. | 220/324 X |

*Primary Examiner*—Steven M. Pollard

*Attorney, Agent, or Firm*—Reed Smith Shaw & McClay

[57] ABSTRACT

The invention describes a closing device for the gas-tight closing of an ever-ready container consisting of two shells for respirators. The closing device is arranged on one shell part and has essentially trapezoidally designed tension bands on whose longer side of the trapezoid hook-shaped parts are arranged which engage in correspondingly defined counter parts on the other shell part. A tension lever with unequal legs holds the tension bands together under tension.

7 Claims, 5 Drawing Sheets

CLOSING DEVICE

FIELD OF THE INVENTION

The present invention relates to a closing device for the gas-tight closing/locking of an every-ready container for respirators. More specifically, the present invention relates to a closing device that uses trapezoidal tension bands.

BACKGROUND OF THE INVENTION

In the case of a known locking or closing device for an ever-ready container for respiration, two container shells of equal size are held together with a single-part narrow tension band completely surrounding the two container shells and equipped with a lock designed as a toggle catch. The single-part tension band is held captive on one of the shells. The toggle-catch-type lock consists of a pivotal hoop at the end of one band, whose external hook-shaped end engages into two hooks at the other end of the band. The tensioned locking hoop, in order to open the container, must be moved about the hoop part which is supported pivotally on one end of the tension band. This is a difficult and uncertain action to be taken by the user of the apparatus in an emergency. Another disadvantage of this opening action is seen in the fact that the single-part narrow tension band surrounding the two container shells causes an unequal distribution of forces, so that an unequal sealing pressure at the circumference of the seal between the two pressed-together container shells cannot be excluded.

SUMMARY OF THE INVENTION

Accordingly, an object of the present invention is to provide a closing device for the gas-tight closing of an every-ready container for respirators consisting of two shells of essentially equal size which can be opened quickly and simply in an emergency, and which generates at all locations of the seal between the upper shell part and the lower shell part an approximately equal sealing pressure.

This and other objects of the present invention are achieved with a closing device with tension bands for the gas-tight closing of an ever-ready container comprised of an upper shell and a lower shell of approximately equal size for respirators. The tension bands are pulled together and held by a toggle catch. The closing device is comprised of improvements which include that the tension bands are arranged on the upper shell and are designed trapezoidally. The longer side of each trapezoid has hook-shaped parts which engage into correspondingly defined counter parts arranged at corner points of the lower shell. A locking element is provided for the tension bands and is disposed between the shorter sides thereof. Also, a tension lever having a shorter and longer lever leg extends from the locking element with the longer lever leg surrounding adjacent edge portions of the upper and lower shells.

The advantages achieved with the invention are in particular that the closing device for the gas-tight closing of the ever-ready container assures an equal sealing pressure at all locations of the seal between the two shell parts, and that the container can be opened quickly and easily in an emergency. In addition, all functional parts of the closing device are covered and protected from external effects.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENTS

Figure 1:
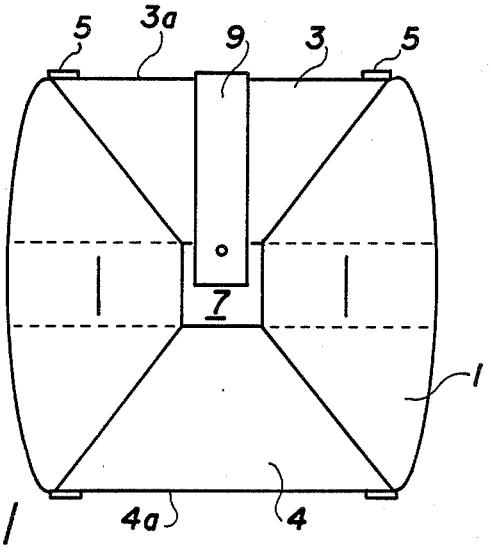
FIG. 1 is a schematic representation of the ever-ready container with the closing device according to the invention (top view).

Referring now to the drawings, wherein like reference numerals designate identical or corresponding parts throughout the several views, as shown in FIG. 1, two trapezoidally designed tension bands 3 and 4 are arranged on the upper shell 1. At the free ends of the longer side 3*a* and 4*a* of the trapezoid of the tension bands 3, 4 hook-shaped parts 5 are provided, which engage into correspondingly defined counter parts 6 which are arranged at the corner points 2*a* of the lower shell 2. At the other free ends of the shorter side of the trapezoid of the tension bands 3 and 4, locking element 7 is arranged, which holds the tension bands together in operating condition under tension. Protruding from the locking element 7 is a tension lever 9 with unequal arms, which extends with its longer lever arm around the upper shell edge 1*a* and in part to the lower shell edge 2*a* (see FIG. 3). The lower shell 2 is equipped with carrying loops 11 in order to be fastened on the belt of the user of the equipment.

Figure 2:
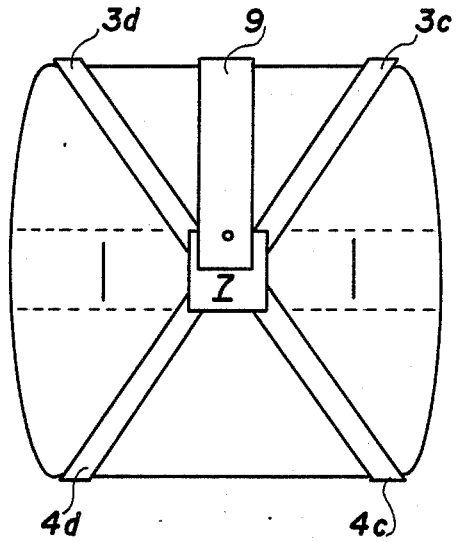
FIG. 2 is a schematic representation of the ever-ready container with another closing device according to the invention (top view).

FIG. 2 shows another embodiment of the design of the tension bands with the closing device, where the basic idea of the trapezoidal action of the tension bands upon the container shells is maintained by subdividing the two tension bands 3 and 4 into four tension bands 3*c*, 3*d* and 4*c*, 4*d*. In this case, each one of the four tension bands on the upper shell 1 is routed separately from the locking element 7 in radial fashion to the corner points of the lower shell and attached there through hook-shaped parts 5 and the counter parts 6.

Figure 3:
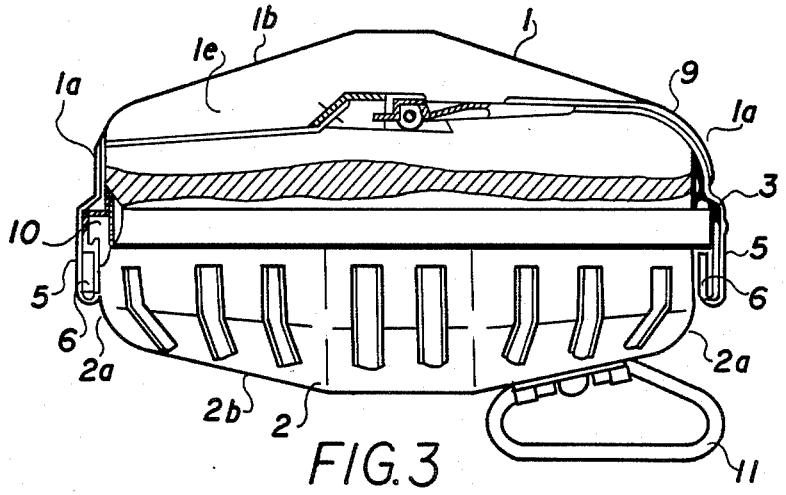
FIG. 3 is a partial lateral view of a version of an ever-ready container with the closing device according to the invention, with a sectional view of the locking position.
Figure 4:
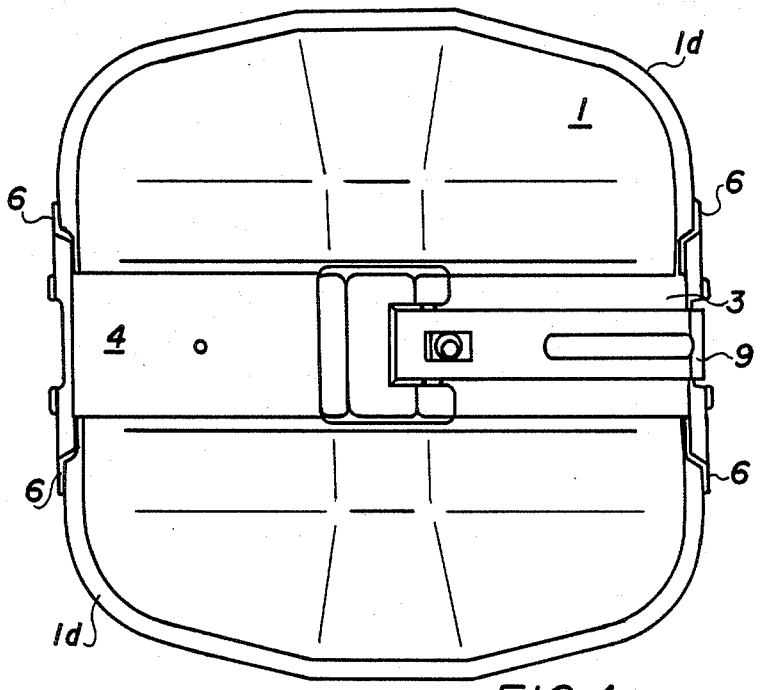
FIG. 4 is a top view according to FIG. 3.

FIG. 3 shows another embodiment of the invention. Here the ever-ready container consists of two shells 1 and 2 of equal size, namely the lower shell part 2 and the upper shell part 1, which in turn consist of a curved bottom part 2*b* and 1*b* with vertically raised edge part 2*a* and 1*a*, and where the opening of the shell is square with rounded corners 2*d*, 1*d* (see FIG. 4). Arranged between the two shells 1 and 2, near the edge of the shells, is a sealing ring 10. After having accepted the respirator, the two shells 1 and 2 are pressed together under tension via the sealing ring 10. In the center of the curved bottom part of the upper shell part 1 is a recess 1*e* which runs without interruption to the raised edge part 1*a* and into which the locking element is embedded.

Figure 5:
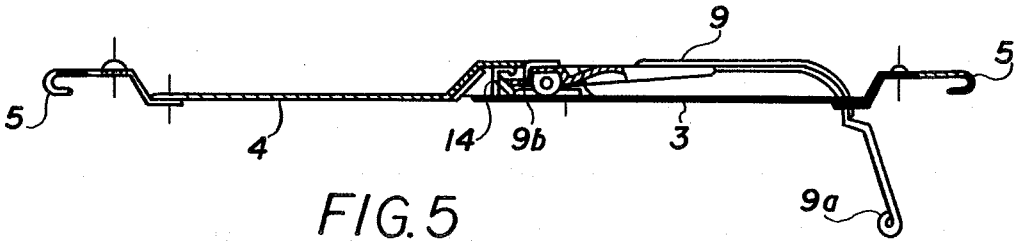
FIG. 5 is a sectional view through the closing device.
Figure 6:
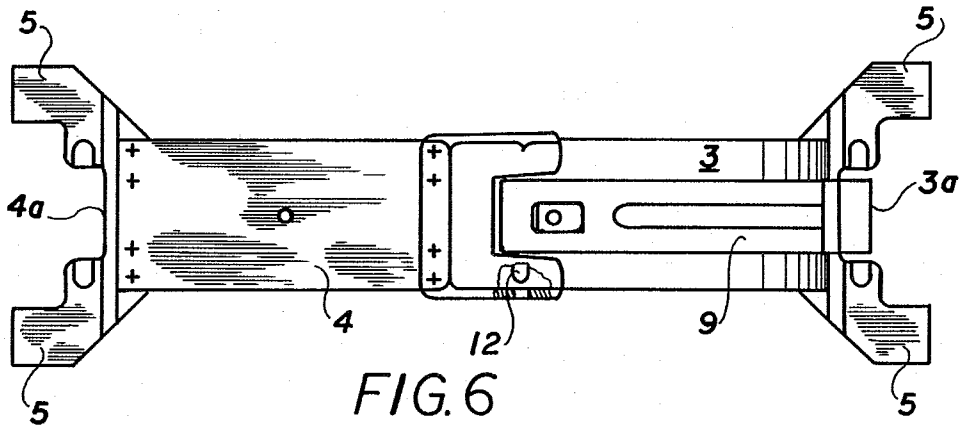
FIG. 6 is a top view of the closing device according to FIG. 5.

In another embodiment, the locking of the closing device is achieved with three parts as shown in FIGS. 5 and 6, namely the two tension bands 3 and 4 and the tension lever 9. In this version of the closing device according to the invention, the basic idea of the invention is also maintained, namely to use tension bands 3 and 4 with trapezoidal effect on the container shells 1 and 2 in order to achieve at all locations of the sealing ring 10 between the lower and the upper shell an even sealing pressure. In order to achieve an equal distribution of forces, the free ends of the tension bands 3 and 4 have four hook parts 5 extending trapezoidally beyond the width of the tension band, which engage into correspondingly shaped eyelets 6 arranged on the lower shell 2 (see FIGS. 3 and 4). The shell parts 1 and 2 are held together under even tension via the toggle-catch-type tension lever 9.

Figure 7:
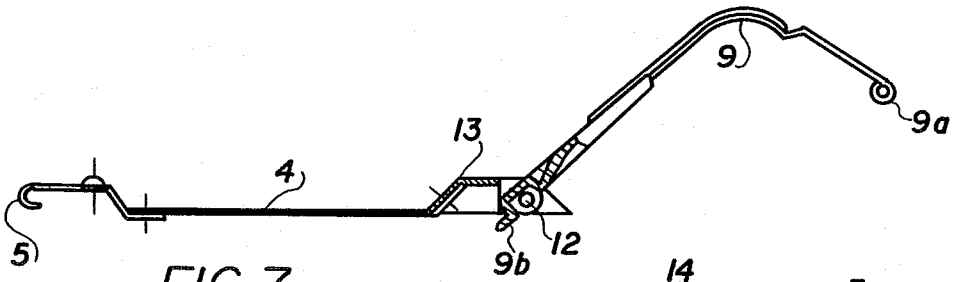
FIG. 7 is a sectional view through the tension band with the tension lever.
Figure 8:
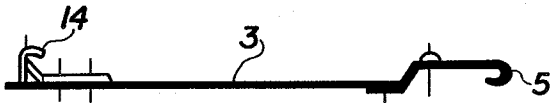
FIG. 8 is a sectional view through the other tension band with an engagement part for the tension lever.
Figure 9:
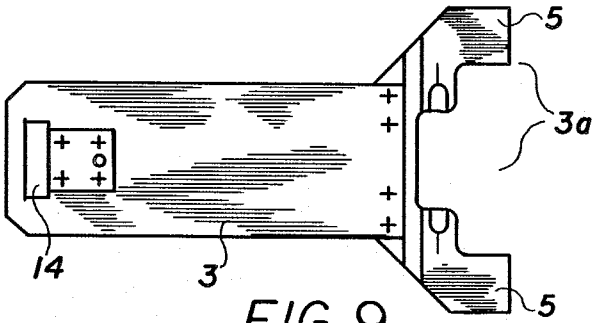
FIG. 9 is a top view of the tension band according to FIG. 8.

FIG. 7 shows that the tension lever 9, having unequal legs is supported in pivotal position at the free end of the tension band 4 which is opposite the hook parts 5, and that the end part 9*a* of the tension lever 9 is curved. In view of this the tension lever 9 when under tension will make close contact with the shell edges 1a and 2*a*. The tension lever 9 will therefore close with the outer contour of the shell edges (see FIG. 4).

Figure 10:
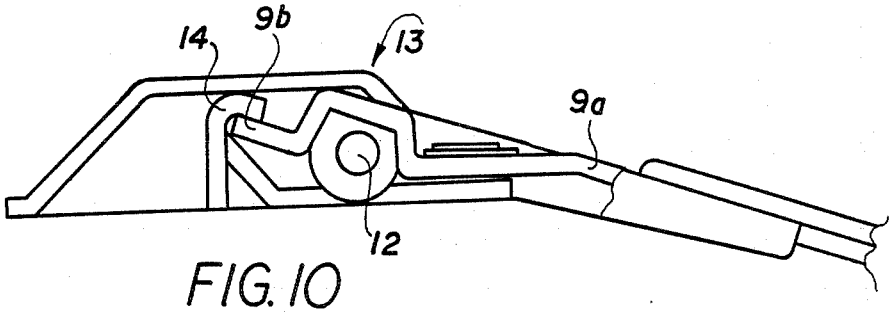
FIG. 10 is a cross-sectional view of the housing.

A rotational axis 12 of the tension lever 9 is supported on two sides by a housing 13 disposed on the shorter end of the tension band 4. Together the rotational axis 12 and the housing 13 form a bearing (see FIGS. 6 and 7). The shorter lever leg 9*b* of the tension lever 9 interacts, when the tension lever closes, with a hook 14 which is arranged at the shorter end of the tension band 3. The end of the shorter lever leg 9*b* presses up against the hook 14, lifting it when the longer lever leg 9*a* is pushed downwards. This causes the tension bands 3, 4 which are attached to the locking element 7 to be pulled up and tightened, since the locking element 7 is attached to the hook 14 which is pulled up. See FIG. 10 which is a cross-sectional view of the housing 13. When the closing device is closed, the housing 13 covers the functional parts of the locking device, namely the bearing with the rotational axis 12 and the shorter lever leg 9*b* with the hook 14. In view of this, these parts are protected from external effects, and in addition there are no protruding parts which could cause injury to the user of the equipment (see FIGS. 3 and 5).

Obviously, numerous (additional) modifications and variations of the present invention are possible in light of the above teachings. It is therefore to be understood that within the scope of the appended claims, the invention may be practiced otherwise than as specifically described herein.

We claim:

1. A closing device with tension bands for the gas-tight closing of an ever-ready container comprised of an upper shell and a lower shell of approximately equal size for respirators, where the tension bands are pulled together and held by a toggle catch, wherein the improvement comprises:

(a) the tension bands are arranged on the upper shell and are designed trapezoidally with the longer side of each trapezoid having hook-shaped parts which engage into correspondingly defined counter parts arranged at corner points of the lower shell;

(b) a locking element for the tension bands disposed between the shorter sides of each trapezoid; and (c) a tension lever having a shorter and longer lever leg, said tension lever extending from the locking element with the end of the longer lever leg surrounding adjacent edge portions of the upper and lower shell.

2. A closing device according to claim 1 wherein from the locking element arranged on the upper shell tension bands extend radially to the corner points of the lower shell and are attached there.

3. A closing device with tension bands for the tight closing of an ever-ready container comprised of an upper shell and a lower shell of approximately equal size for respirators, where the tension bands are pulled together and held by a toggle catch, wherein the improvement comprises:

(a) the tension bands are arranged on the upper shell and the free ends thereof have hook parts which trapezoidally extend beyond the width of the tension bands and form a longer side of a trapezoid with the free ends;

(b) a locking element for the tension bands disposed between the shorter sides of each trapezoid; and (c) a tension lever having a shorter and longer lever leg, said tension lever extending from the locking element with the end of the longer lever leg surrounding adjacent edge portions of the upper and lower shell.

4. A closing device according to claims 1 or 3, wherein the tension lever is supported in a rotatable position, and the end part of the longer lever leg of the tension lever is curved.

5. A closing device according to claim 4 wherein the tension bands include a first tension band located under the longer lever leg of the tension lever and a second tension band; and wherein the tension lever has a rotational axis which is supported on two sides by a housing disposed on the shorter end of the second tension band, said rotational axis and said housing together form a bearing, said rotational axis disposed between the shorter and longer lever leg.

6. A closing device according to claim 5, wherein the shorter lever leg of the tension lever interacts with a hook arranged at the shorter end of the first tension band when the tension lever is being closed.

7. A closing device according to claim 6, wherein the housing protects the shorter lever leg, the hook and the rotational axis of the tension lever.

* * * * *